US005915451A

United States Patent [19]

Nakamura

[11] Patent Number: 5,915,451

[45] Date of Patent: Jun. 29, 1999

[54] CASTING CORE FABRICATION APPARATUS

[75] Inventor: Nobuhiro Nakamura, Osaka, Japan

[73] Assignee: Osaka Shell Industry Co., Ltd., Japan

[21] Appl. No.: 08/914,508

[22] Filed: Aug. 19, 1997

[30] Foreign Application Priority Data

Aug. 19, 1996 [JP] Japan ..... 8-217286

[51] Int. Cl.[6] ..... B22C 13/08

[52] U.S. Cl. ..... 164/165; 164/21

[58] Field of Search ..... 164/165, 166, 164/186, 21

[56] References Cited

U.S. PATENT DOCUMENTS 4,129,169 12/1978 Biedacha et al. ..... 164/166
4,232,726 11/1980 Michelson ..... 164/165 X

FOREIGN PATENT DOCUMENTS 5-23794 2/1993 Japan ..... 164/186
5-30833 8/1993 Japan .
5-305386 11/1993 Japan .
177047 1/1966 U.S.S.R. ..... 164/165

*Primary Examiner*—J. Reed Batten, Jr.
*Attorney, Agent, or Firm*—Schweitzer Cornman Gross & Bondell LLP

[57] ABSTRACT

A mold sand feeding tank 4 is provided for feeding mold sand S into a hollow core molding portion 2 defined by a pair of molds 1*a* and 1*b* mating with each other. A switching valve 7 is disposed within the mold sand feeding tank 4 and has a mold sand feeding opening 5, through which the mold sand S is fed into the mold sand feeding tank 4 from the outside, and a mold sand discharging opening 6, through which non-hardened mold sand Sb within the hollow core molding portion 2 is directly and externally discharged.

10 Claims, 10 Drawing Sheets

CASTING CORE FABRICATION APPARATUS

FIELD OF THE INVENTION

The present invention relates to a casting core fabricating machine for fabricating a hollow casting core using a core-forming material such as sand containing thermosetting resin.

BACKGROUND OF THE INVENTION

Casting cores are conventionally prepared by machinery such as is described in commonly owned Japanese examined utility model publication (Kokoku) No. Heisei 5-30833 and in Japanese unexamined patent publication (Kokai) No. Heisel 5-305386. In the proposed conventional machinery a mold sand feeder tank includes a mold sand tank portion filled with mold sand and an air supply and discharge chamber which supplies pressurized air to the lower portion of the mold sand feeder tank through metal wire mesh and applies suction. The mold sand filling the mold sand tank portion is fed into a hollow core molding portion formed by clamping together a pair of divided mold portions. The mold sand is fed into the hollow portion where it contacts with the wall surface of the core fabrication apparatus and is heated and becomes hardened. This is, because the sand is coated with a thermosetting resin. This coated sand is referred to in the specification with its claims as "mold sand."

Subsequently suction is applied to the hollow core molding portion through the mold sand in the mold sand tank portion and through a gap of the mold sand by switching into air exhausting from the air supply and discharge chamber. The unheated, non-hardened, loose mold sand in the center portion of the hollow core molding portion is collected in the same mold sand tank.

In the aforementioned conventional machine, while the mold sand is fed from the mold sand tank portion of the mold sand feeding tank to the hollow core molding portion to heat and harden the mold sand in the center portion, the pressurized air in the air supply and discharge chamber has to be constantly supplied toward the hollow core molding portion so that the mold sand will not leak by flowing from the hollow core molding portion to the mold sand tank portion.

On the other hand, when the non-hardened mold sand is recovered into the mold sand tank after hardening of the mold sand by heating it in the hollow core molding portion, the suction is applied to the hollow core molding portion through the mold sand filled in the mold sand tank portion and through a gap of the mold sand, by switching to exhausting air from the air supply and discharge chamber located below the mold sand tank portion. Therefore, the mold sand interferes with the action of the suction and results in delay and lowers the mold sand correcting efficiency. Due to the low suction, vibration action is applied to recover the non-hardened mold sand in the hollow core molding portion to release the non-hardened sand from the wall surface of the hollow core molding portion for its recovery. This is a source of unwanted noise in the workplace.

On the other hand, undesired semi-hardened or hardened mold sand can be recovered into the mold sand tank portion together with the non-hardened mold sand with the mold sand hardened by heating by contact with the wall surface of the hollow core molding portion. The non-hardened mold sand recovered into the mold sand tank portion is again fed into the hollow core molding portion. When the mold sand is fed into the hollow core molding portion together with semi-hardened mold sand and the hardened mold sand, the firm hollow core cannot be formed. The wall of the hollow core becomes broken away and makes it impossible to mold the core.

SUMMARY OF THE INVENTION

It is an object of the present invention to provide a casting core fabrication machine which makes it unnecessary constantly to supply pressurized air from an air supply and discharge chamber into a hollow core molding portion while the mold sand is heated for hardening within the hollow core molding portion, and to quickly recover non-hardened mold sand into a mold sand tank portion after the part of the mold sand in the hollow core molding portion that contacted the walls solidified by heating, to reduce required vibration as much as possible, and to avoid undesired recovery and refeeding of semi-hardened or hardened mold sand, by rather recovering the non-hardened mold sand into an external portion other than the mold sand tank portion through a path other than a path for feeding the mold sand into the hollow core molding portion.

To accomplish the above-mentioned and other desired objectives of the present invention, a casting core fabrication machine is provided in which mold sand is fed into a hollow core molding portion defined by a pair of heated, divided, mating portions wherein the mold sand is heated and hardened by contacting the mold, with the divided molds, and then the non-hardened mold sand within the center portion of the hollow core molding portion is discharged, wherein the machine has a mold sand feeding tank for feeding the mold sand into the hollow core molding portion, and a switching valve within the mold sand feeding tank and having a mold sand feeding opening, through which the mold sand is fed into the mold sand feeding tank from the outside, and a mold sand discharging opening, through which non-hardened mold sand within the hollow core molding portion is directly and externally discharged.

BRIEF DESCRIPTION OF THE DRAWINGS

The present invention is described in greater detail with reference being made to the accompanying drawing of the suitable embodiments of the invention, wherein.

DETAILED DESCRIPTION

Figure 1:
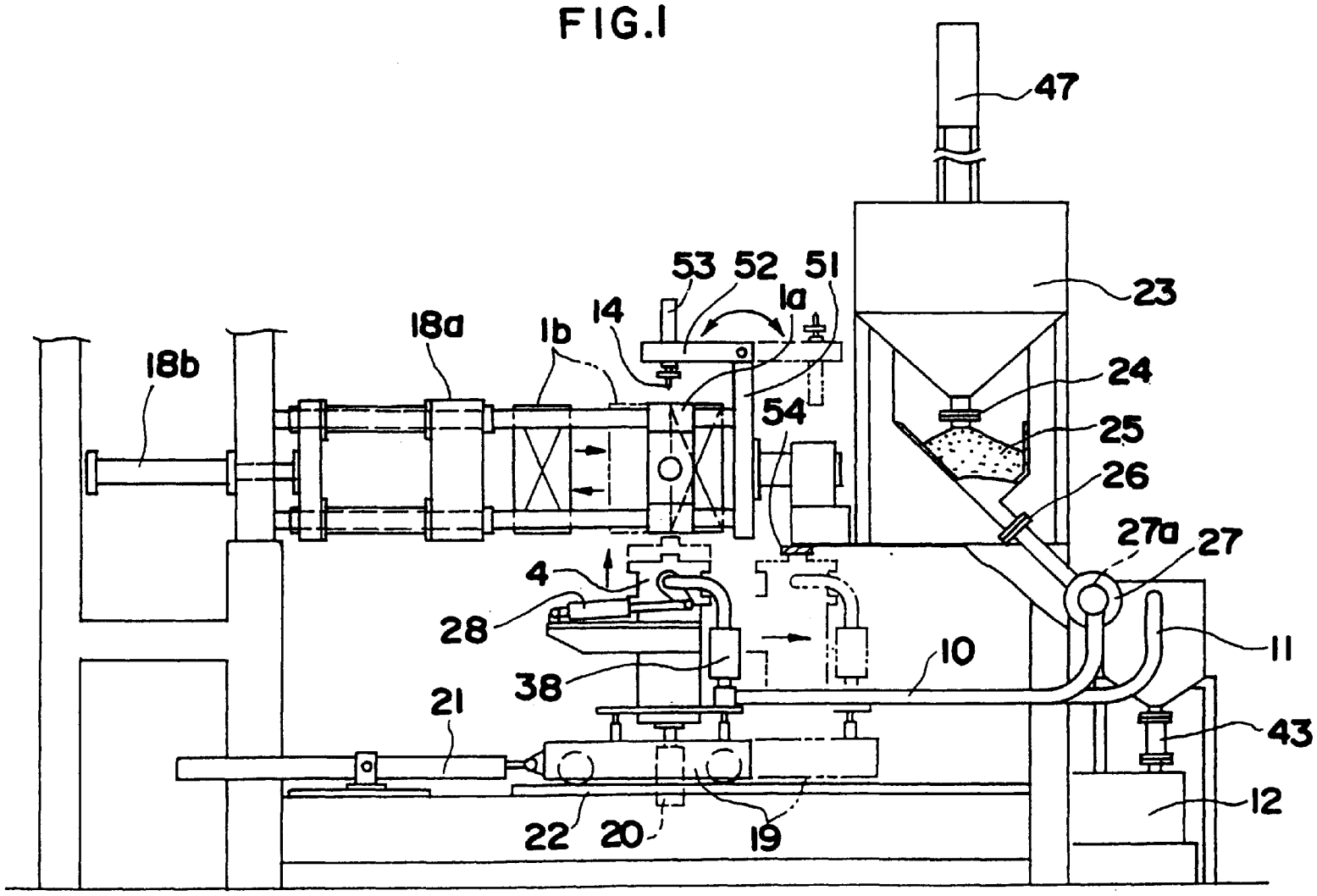
FIG. 1 is a front elevation of an embodiment of a casting core fabricating machine according to the present invention.
Figure 2:
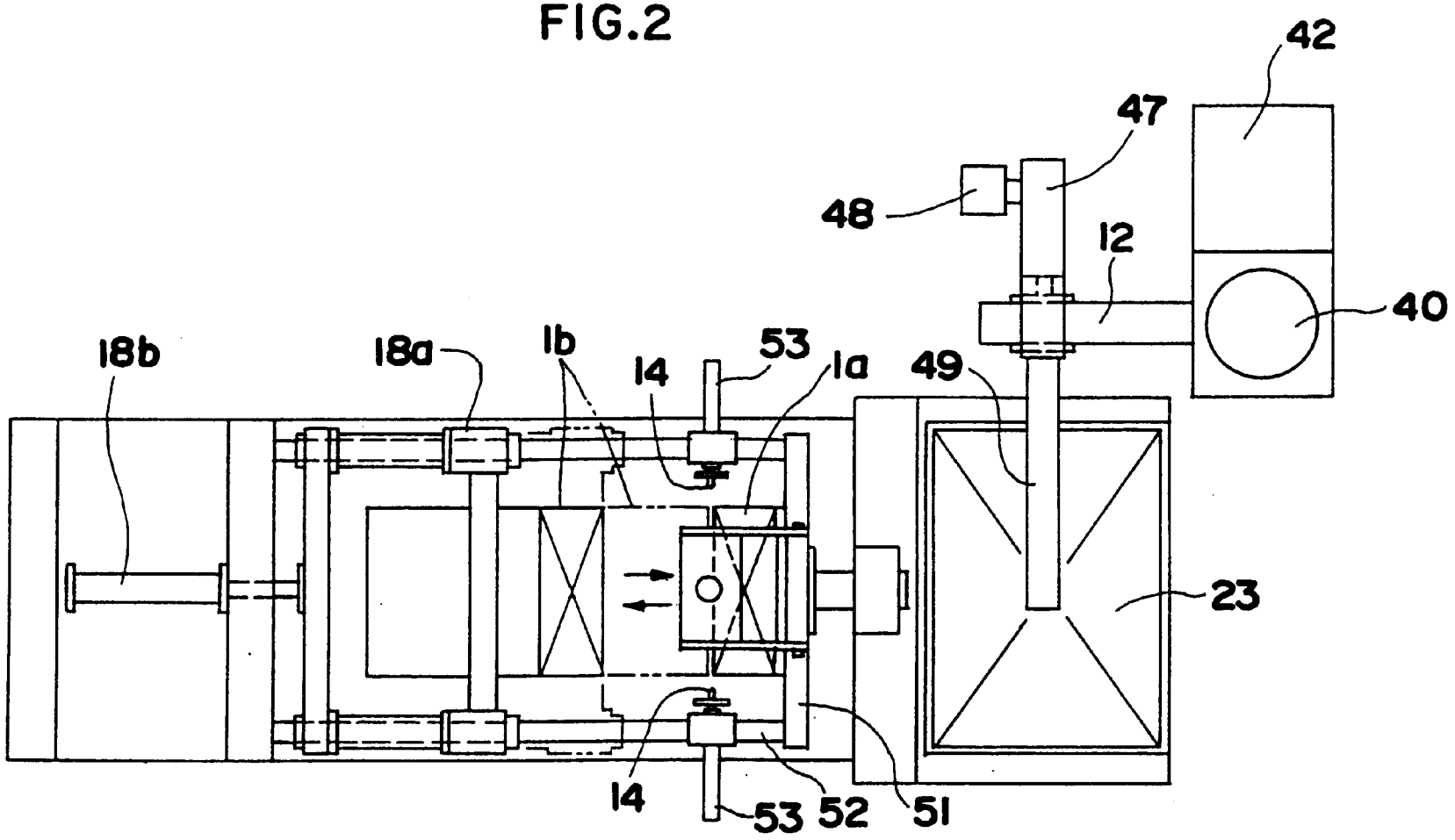
FIG. 2 is a top view of the machine of FIG. 1.
Figure 3:
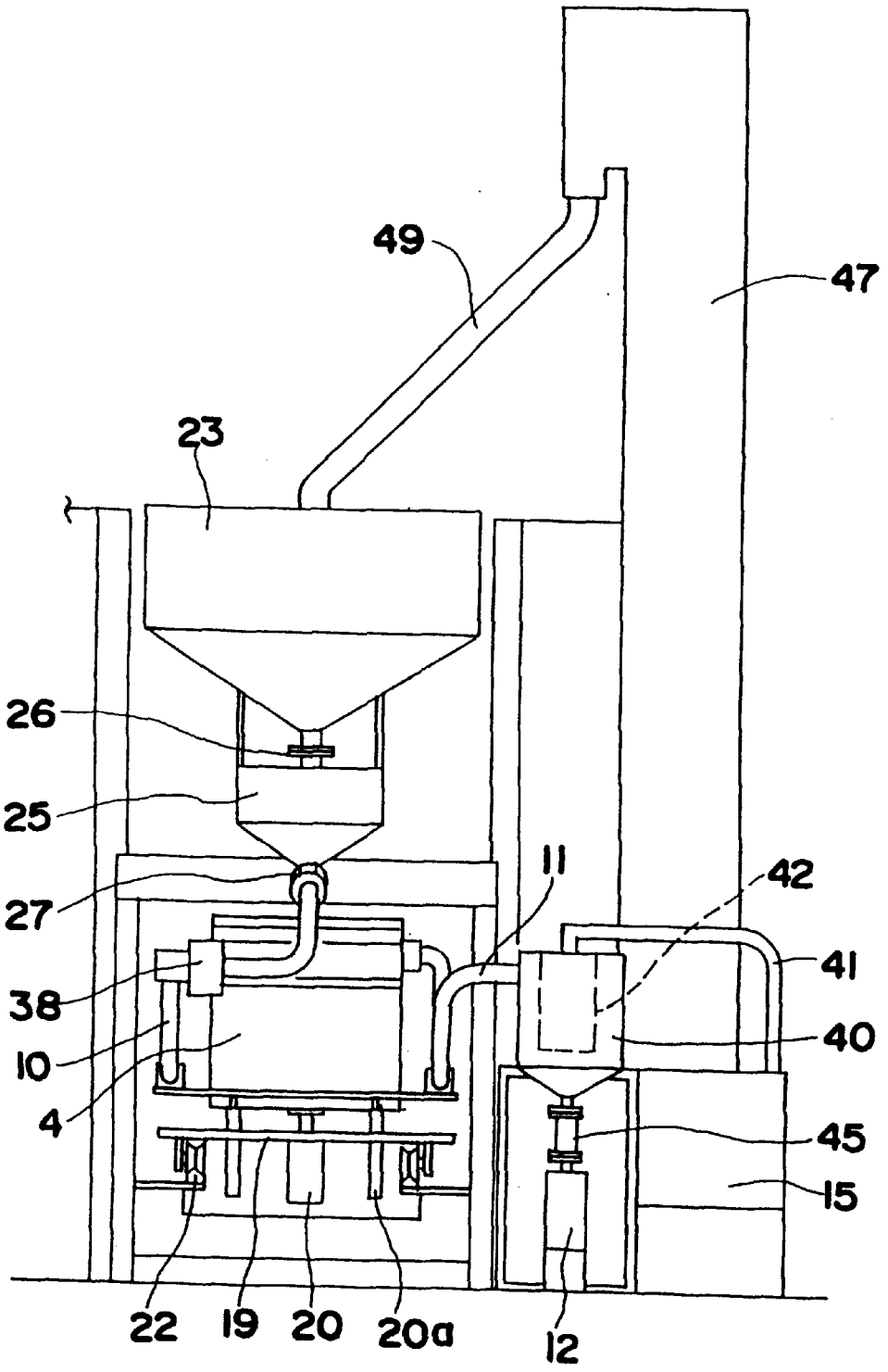
FIG. 3 is a side elevational view of the machine of FIG. 1.

An external view of an embodiment of a casting core fabricating machine of the present invention is shown in FIGS. 1–3. From a pair of divided mold portions 1*a* and 1*b*, the mold portion 1*a* is a stationary mold portion supported on a stationary frame, and the other mold portion 1*b* is a movable mold portion supported on a movable frame 18*a* which is movable along a guide bar and moved toward and away from the stationary mold 1*a* by a mold moving cylinder 18*b* as illustrated by broken and by solid lines.

A mold sand feeding tank 4 is arranged right below a position where the movable mold portion 1*b* mates with the stationary mold portion 1*a* as shown by broken line in FIG. 1. As shown in greater detail in FIG. 7, the mold sand feeding tank 4 includes a mold sand tank portion 4*a* filled with a mold sand S, a wire mesh 4*c* located in a lower part of the mold sand portion 4*a,* and having a mesh size to pass air but to block the mold sand, and an air supply chamber 4*b* for supplying air to the tank portion 4*a* through the wire mesh 4*c*. The air supply chamber 4*b* is connected to an air supply hose.

The mold sand feeding tank 4 if mounted on a carriage 19 shown in FIGS. 1 and 3. The mold sand feeding tank 4 is supported on a vertical guide rod 20*a* of a lifting cylinder 20 for lifting the tank up toward the position where the divided mold portions 1*a* and 1*b* are mated. The mold sand feeding tank 4 is reciprocated between the positions illustrated by the solid line and the broken line by a carriage driving cylinder 21, guided by a guide rail 22.

A mold sand charge hopper 23 is provided at the upper end of the motion stroke of the mold sand feeding tank 4 shown by the broken line. The hopper 23 is connected to a lower tank 25 through a gate 24. The lower tank 25 is connected to a cylindrical metering cell 27 through valve 26. An air supply pipe 27*a* is provided on one end of the metering cell 27. The other end of the metering cell 27 is connected to a mold sand feeding hose 10. The mold sand feeding hose 10 is connected to a switching valve 7 (FIG. 6) in the mold sand feeding tank 4.

Figure 6:
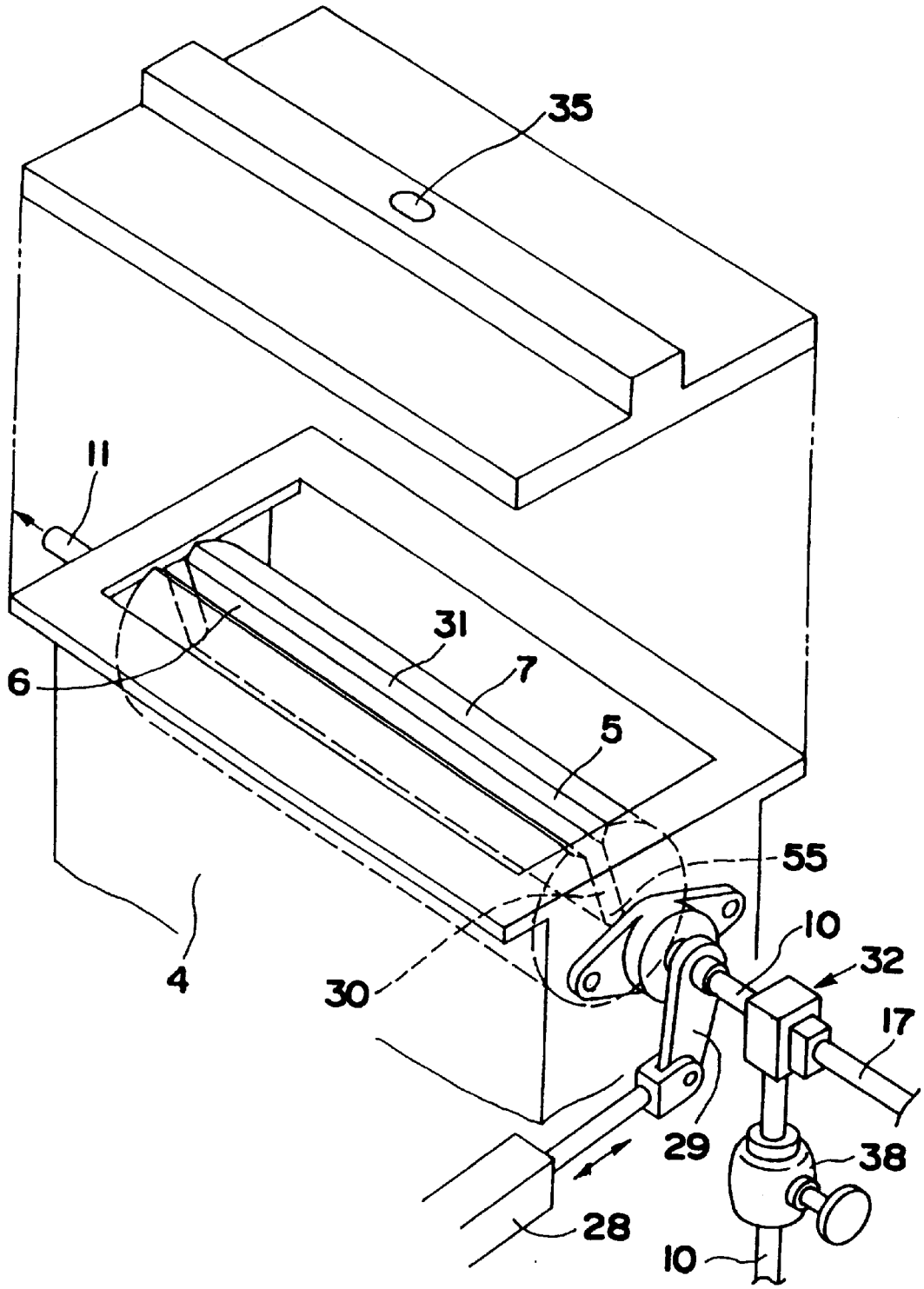
FIG. 6 is a perspective view of the most significant parts of the machine of FIG. 1.
Figure 7:
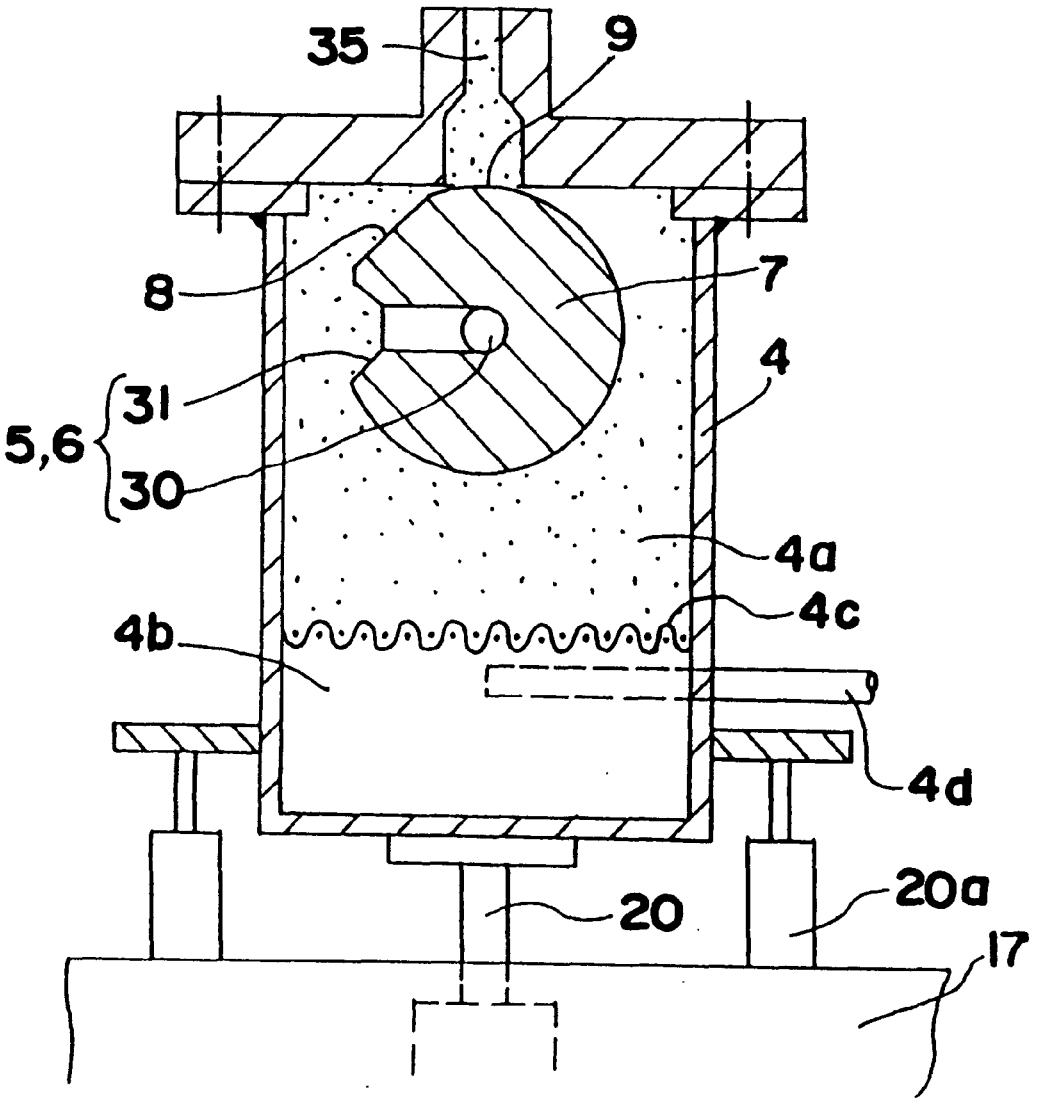
FIG. 7 is a longitudinally cross-sectional view of the machine of FIG. 1.
Figure 8A:
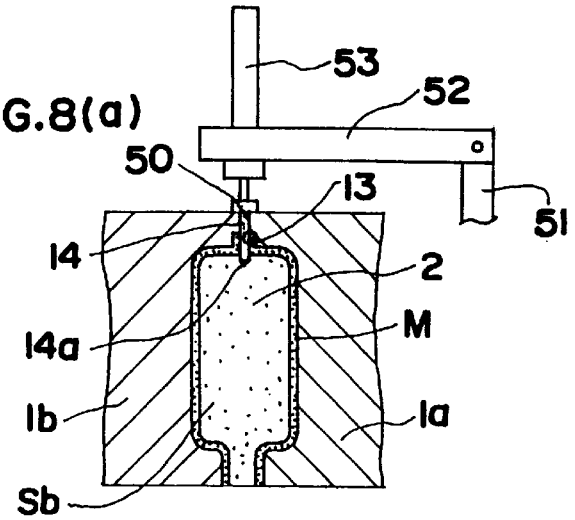
FIGS. 8(*a*) to 8(*d*) are explanatory longitudinal cross-sectional views showing the operating condition of parts shown in FIG. 7.
Figure 8B:
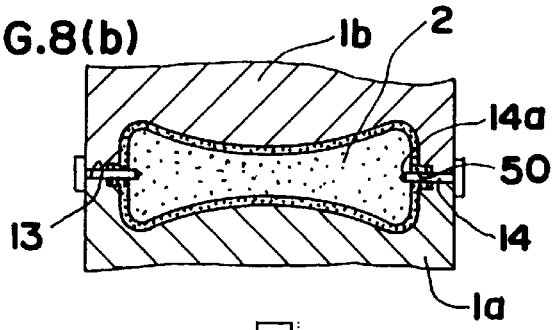
Figure 8C:
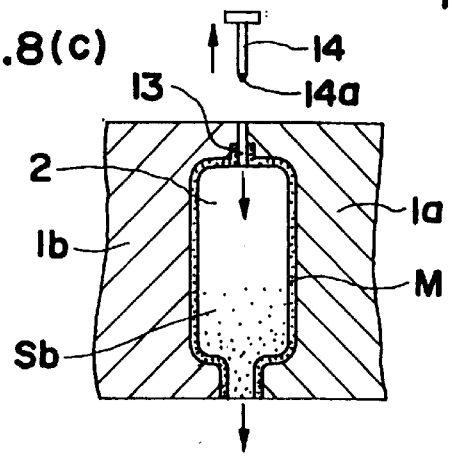
Figure 8D:
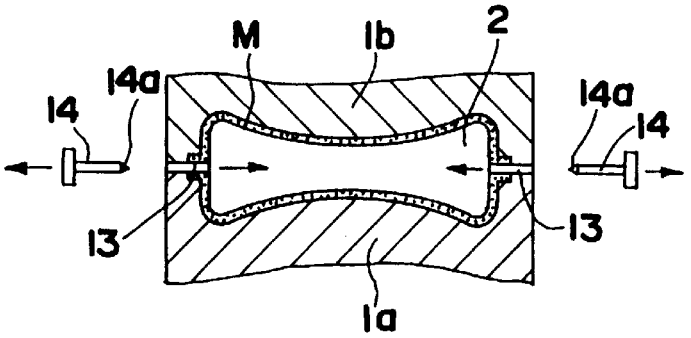
Figure 9A:
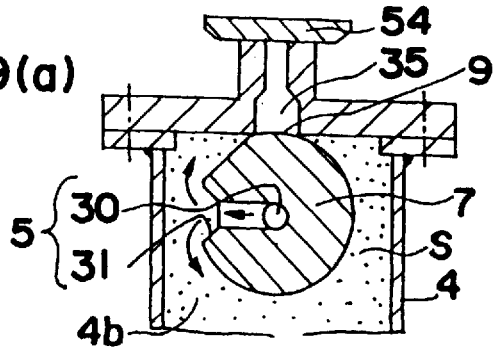
FIGS. 9(*a*) to 9(*d*) are further explanatory longitudinal cross-sectional views showing operating condition of other parts shown in FIG. 7.
Figure 9B:
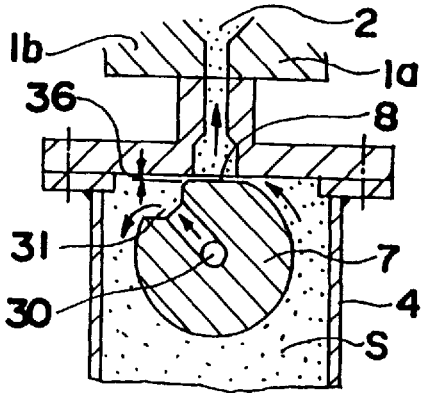
Figure 9C:
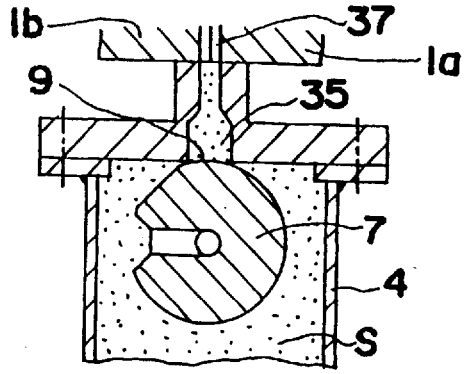
Figure 9D:
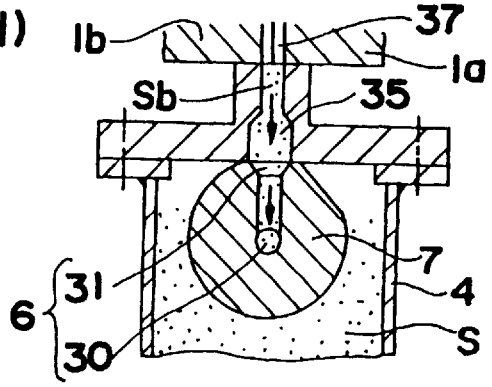

As shown in FIGS. 1 and 6, the switching valve 7 in the mold sand feeding tank 4 is a thick rotary type cylinder which is rocked circumferentially by a valve switching cylinder 28 and a switching arm 29 connected between the cylinder 28 and the valve 7. As best shown in FIG. 7, the switching valve 7 is formed with a mold sand flow passage 30 extending longitudinally along the axial center of the valve 7. A hopper shaped mold sand feeding and discharging opening 31 is formed communicating with the entire longitudinal area of the flow passage 30. The mold sand flow passage 30 and the mold sand feeding and discharging opening 31 together form a mold sand feeding opening 5 and a mold sand discharging opening 6, to be described in greater detail.

Figure 4A:
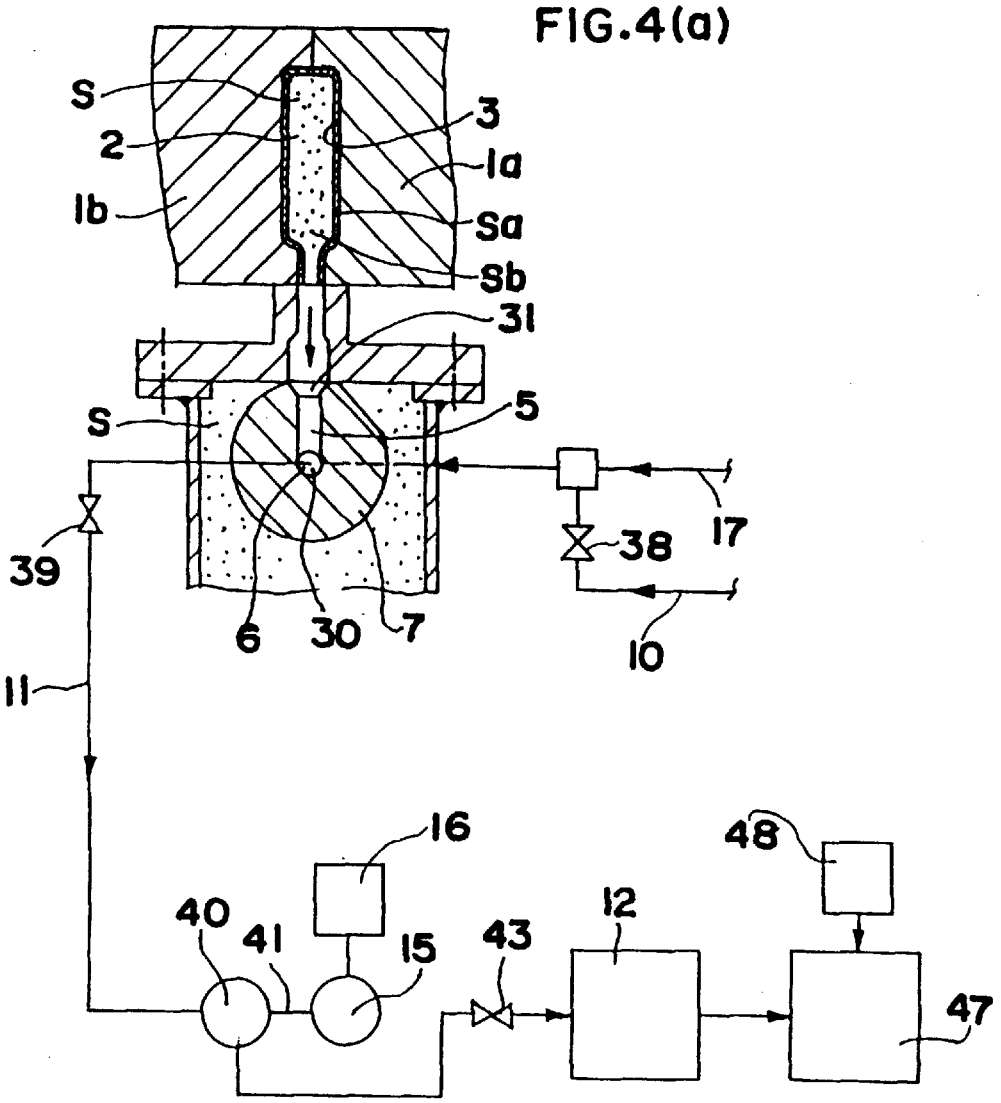
FIGS. 4(*a*) and 4(*b*) are longitudinal cross sectional views of the most significant parts of the machine of FIG. 1.
Figure 4B:
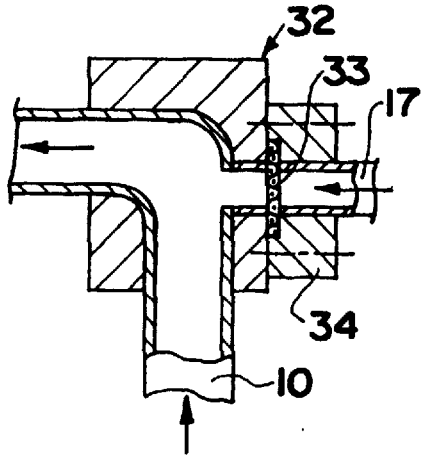

As best shown in FIG. 6, the switching valve 7 is connected to the mold sand feeding hose 10 for feeding the mold sand S into the mold sand feeding tank 4 at one end and to a mold sand suction holder 11 for discharging mold sand S from the hollow core molding portion 2 at the other end. One end of the switching valve 7 is connected to a mold sand discharging air hose 17 for supplying air into the mold sand discharging opening 6 upon discharging the mold sand S from the hollow core molding portion 2 to the exterior. In the embodiment shown, the mold sand discharging air hose 17 is connected to the intermediate portion of the mold sand feeding hose 10 by a joint member 32, as shown in FIGS. 4(*a*), 4(*b*), 5, and 6, and thus the mold sand feeding hose 10 is in communication with one end of the switching valve 7. On the other hand, as shown in FIG. 4(*b*), a metal wire mesh filter 33 is disposed at the connecting portion of the mold sand discharging air hose 17 to the mold sand feeding hose 10. This filter 33 permits the air to pass but blocks the mold sand from passing through and is mounted by a flange 34.

As shown in FIG. 7, the outer peripheral surface of the switching valve 7 has a portion formed into a flat surface 8. The flat surface 8 defines a mold sand feeding gap 36 (see FIG. 9(*b*)) between a mold sand supplying and discharging hole 35 when the surface 8 is mated with the hole. The mold sand S in the mold sand tank portion 4*a* is fed into the hollow core molding portion 2 through the mold sand feeding gap 36. Accordingly, the flat surface 8 is a mold sand feeding surface 8. Also, an arcuate surface 9 is formed adjacent the mold sand feeding plane 8 on the periphery of the switching valve 7. When the arcuate surface 9 adjoins the mold sand supplying and discharging hole 35 (see FIG. 9(*c*)), it blocks the latter so that the mold sand S in the hollow core molding portion will not leak to the mold sand tank 4*a* through a supplying and discharging opening 37. Accordingly, the arcuate surface 9 acts as a mold sand blocking surface. Flow opening and closing valves 38 and 39 are provided at respective ends of the switching valve 7 (see FIGS. 4(*a*) and 5).

Figure 5:
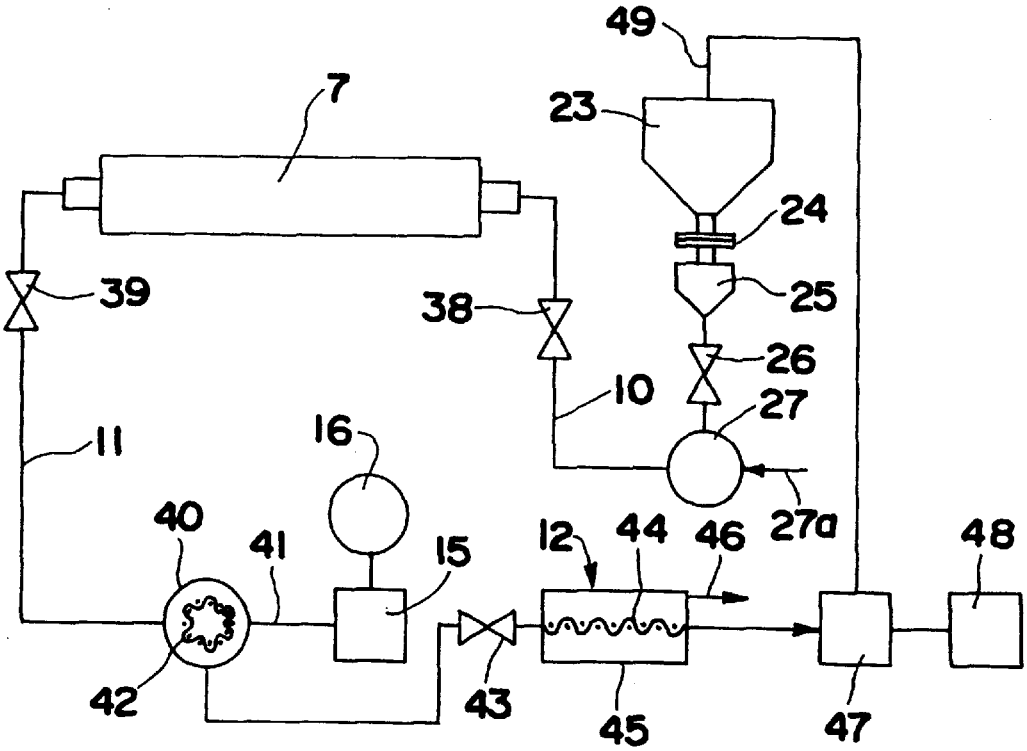
FIG. 5 is a schematic diagram of the most significant parts of the machine of FIG. 1.

As best shown in FIGS. 4(*a*) and 4(*b*), and particularly in the explanatory schematic of FIG. 5, an end of the switching valve 7 opposite to where the mold sand is fed thereunto, is connected to the mold sand suction hose 11 through valve 39. The suction hose 11 is connected to a suction pump 15 through a relay chamber 40 and a relay hose 41. The suction pump 15 is provided with an inverter 16 (see also FIG. 4(*a*)) for adjusting the suction. A filter bag 42 is disposed in the relay chamber 40 to prevent the recovered mold sand S from entering into the pump 15. The recovered mold sand S is passed through a filter 12 through a valve 43.

The filter 12 includes a metal wire mesh screen 44 which is vibrated to pass the mold sand S having a predetermined maximum grain size to block the mold sand S having a greater grain size than the predetermined maximum and a receiving plate 45 located beneath the metal wire mesh screen 44. The mold sand with the larger size is discharged to the exterior at 46 by the vibrating action of the screen 44. On the other hand, the mold sand with smaller grain size is caught on the receiving plate 45 and fed into a sand pump 47 by vibration. The filtered mold sand is recycled.

As best shown in FIGS. 2, 4(*a*), and 5, the sand pump 47 is connected to a sand hopper 48 for supplying fresh mold sand S and to the filter 12. Thus, the fresh mold sand S from the hopper 48 and the non-hardened mold sand S recovered from the filter 12 are together fed upwardly to the mold sand charge hopper 23 through a mold sand supply pipe 49.

As shown in FIGS. 8(*a*)–8(*d*), due to a parting 50 between the mold parts 1*a* and 1*b*, air can communicate between the interior and the exterior of the mold along an air introducing aperture 13. As shown in FIGS. 8(*a*) and 8(*c*), the air introduction apertures 13 are formed through both interior sides of the divided mold halves 1*a* and 1*b*. The air introduction aperture 13 is adapted to be releasably plugged by a closing pin 14. In the plugged condition, the tip end 14*a* of the pin 14 is slightly projected into the hollow core 2 of the mold.

As best shown in FIGS. 1 and 2 and in FIGS. 8(*a*) to 8(*d*) in greater detail, the closing pins 14 on the upper and side surfaces of the divided mold parts 1*a* and 1*b,* are carried by pin moving cylinders 53 mounted on a supporting frame 52 that extends from a machine housing 51 for vertical and lateral insertion of the pins 14 into the air introduction apertures 13 and to be reciprocatingly released therefrom.

When the closing pins 14 are not in use, the pin moving cylinder 53 can be pivotally turned outwardly as shown by the broken line in FIG. 1.

In operation the aforedescribed casting core fabrication apparatus of the present invention, as shown in FIG. 1, the mold sand feeding tank 4 is moved toward the mold sand charge hopper 23 by the carriage 19 as shown by the broken line. At this position, the mold sand supplying and discharging hole 35 of the mold sand tank portion 4*a* is closed by a sealing plate 54 (see FIGS. 1 and 9(*a*)). As shown in FIG. 9(*a*), at the same time the switching valve 7 is turned to orient the mold sand feeding and discharge opening 31 horizontally to close the mold sand supply and discharge hole 35 by the arcuate mold sand blocking surface 9. In the condition, as shown in FIG. 5, by opening the gate of the sand charge hopper 23 the mold sand S is charged into the lower tank 25 from the mold sand charge hopper 23. Also, by opening the valve 26 the mold sand S is introduced into the cylindrical metering cell 27. Pressurized air is introduced into the metering cell 27 from the air supply pipe 27*a* under pressure. Thus a predetermined amount of mold sand S is supplied to the switching valve 7 from a mold sand supply hole 55 at one end of the switching valve 7 (see FIG. 6) through the mold sand feeding hose 10. Then, the mold sand S is fed into the mold sand tank portion 4*a* of the mold sand feeding tank 4 through the mold sand flow passage 30 of the switching valve 7 and the hopper shaped mold sand supply and discharge opening 31 to fill the mold sand tank portion 4*a*. Thus the mold sand flow passage 30 of the switching valve 7 and the mold sand supply and discharge opening 31 form the mold sand feeding opening 5 for the mold sand feeding tank 4.

As shown in FIG. 1, next the mold sand feeding tank 4 is moved by the carriage 19 to a position located right below the position where the divided mold portions 1*a* and 1*b* are as shown by solid lines in FIG. 1. As best shown in FIG. 9(*b*), at this position the switching valve 7 is pivoted by the valve switching cylinder 28 and the switching arm 29 to bring the flat, mold sand feeding surface 8 in contact with the mold sand supply and discharge hole 35 of the mold sand tank portion. This defines the mold sand feeding gap 36 between the mold sand supply and discharge hole 35 and the flat, mold sand feeding surface 8.

Thereafter, as best shown in FIG. 7, compressed air is supplied to the air supply chamber 4*b* at the lower side of the mold sand tank portion 4*a* from the air supply hose 4*d*. Thus, compressed air is supplied to the mold sand tank portion 4*a* through the metal wire mesh screen 4*c*. As best shown in FIG. 9(*b*) the air pressure feeds the mold sand S from the mold sand tank portion 4*a* into the hollow core molding portion 21 within the pair of divided mold portions 1*a* and 1*b*, through the mold sand feeding gap 36.

A predetermined amount of the mold sand S is fed into the hollow core molding portion 2. Next, as shown in FIG. 9(*c*), by further pivoting the switching valve 7, the arcuate surface 9, i.e. the mold sand blocking surface on the outer periphery mates with the mold sand supply and discharge hole 35 of the mold sand tank portion 4*a* to prevent leaking out of the mold sand S from the supplying and discharging opening 37 into the mold sand tank portion 4*a*. In this condition, the mold sand S fed into the hollow core molding portion 2 is heated by the wall 3 of the hollow core mold at a temperature of from about 250° C. to about 300° C. from about 60 seconds for the resin content of the sand to be hardened.

As set forth above, the air introducing apertures 13 between the pair of divided mold portions 1*a* and 1*b* that define the hollow core molding portion 2, are closed by the closure pins 14. The tip end portion 14*a* of the closure pin 14 has to extend into the mold sand heated and hardened, to project into the non-hardened part of the mold sand (FIGS. 9(*a*), 9(*b*), and 10(*a*)). Thus when a core M (FIGS. 8(*a*), 9(*b*))) is formed, the air introduction hole aperture 13 is formed in the core M by the closing pin 14. Therefore, it is preferred that the air introduction aperture 13 in the core M is located at a position that does not interfere with subsequent casting operation, such as the position of a base support 56 that supports the core M within the casting mold.

Next, by pivoting the switching valve 7 as further shown in FIG. 9(*d*), the mold sand supplying and discharging opening 31 of the switching valve 7 is located opposite to the supplying and discharging opening 37 of the hollow core molding portion 2 to provide a connection between them. As shown in FIG. 4(*a*), thus the hollow core molding portion 2, the switching valve 7, and the mold sand suction hose 11 are connected with each other.

In this condition, the closing pin 14 on the upper surface and the closing pin 14 of both side surfaces are removed from the air introduction apertures 13 by the pin driving cylinders 53 as shown in FIGS. 1 and 2, and in more detail in FIGS. 8(*c*) and 8(*d*) to actuate the suction pump 15 of the mold sand suction hose 11. Depending upon the shape of the hollow core molding portion 2, the closing pins on the upper surface and on both side surfaces are withdrawn simultaneously or in sequential order from one side.

By actuating the suction pump 15 of the mold sand suction hose 11 in conjunction with withdrawal of the closing pins 14 from both divided molds 1*a* and 1*b*, the non-hardened mold sand Sb within the hollow core molding portion 2 is sucked out and is discharged directly to the exterior through the mold sand suction hose 11 through the mold sand supplying and discharging opening 31 and the mold sand flow passage 30 of the switching valve 7. Accordingly, the mold sand supplying and discharging opening 31 and the mold sand flow passage 30 of the switching valve 7 form a mold sand discharge opening 6 for sucking and discharging the mold sand Sb to the exterior of the machine.

Figure 10A:
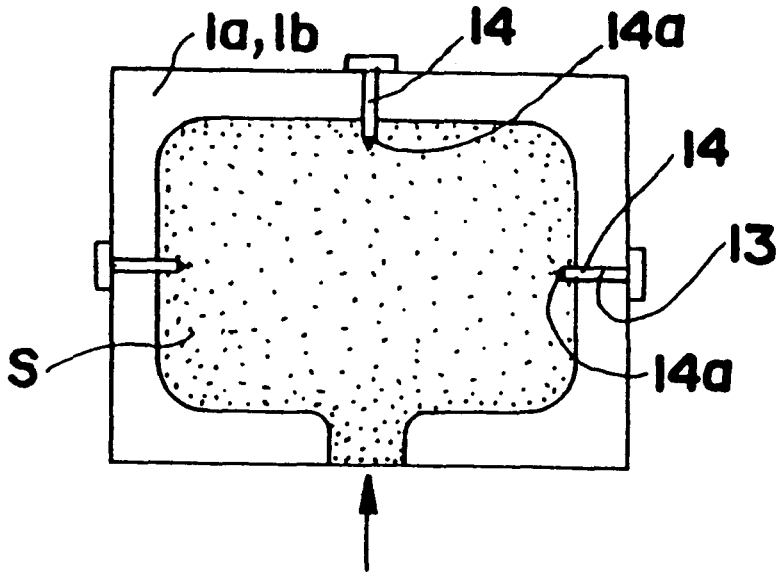
FIGS. 10(*a*) and 10(*b*) are longitudinal cross-sectional views of molding condition of a core made by the present invention.
Figure 10B:
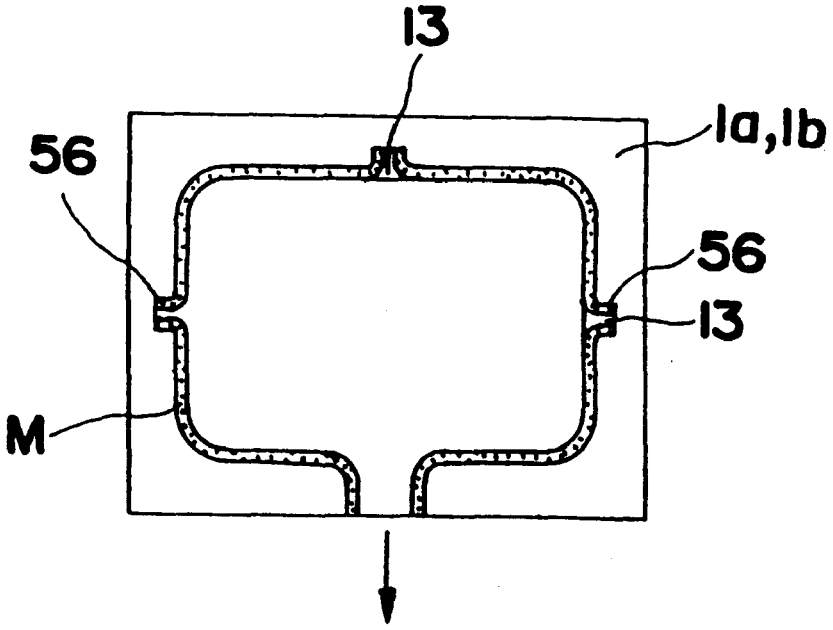

After discharging of the non-hardened mold sand Sb in the hollow core molding portion 2, the thus formed hollow core M (see FIG. 10(*b*)) alone remains within the hollow core molding portion 2. The divided mold portions 1*a* and 1*b* are released from their mating position to remove the hollow core M from the inside. Then, after removing the hollow core M, the divided mold portions 1*a* and 1*b* are mated again, the closing pins 14 are plugged into the ambient air introduction apertures 13 for closing and readying the machine for a new core molding cycle.

Suction and the action of the ambient air through the air introducing apertures 13 in the described embodiment of the present invention removes soft mold sand from the interior of the hardened mold sand Sa heated and hardened in contact with the hollow core molding portion 2 and the core mold wall 3. Thus, the soft, non-hardened mold sand inside of the hardened mold sand Sa can be quite efficiently discharged to the exterior. In this connection, the suction of the pump 15 to be introduced into the mold sand suction hose 11 is not required to be excessively high.

On the other hand, it is possible to avoid the air introduction apertures 13 and the closing pins 14 in the divided mold portions 1*a* and 1*b* as set forth above and use more conventional prior art molds to connect the mold sand discharging air supply hose 17 to the mold sand feeding hose 10 which is connected to one end of the switching valve 7. In that case, upon use the valve of the mold sand feeding hose 10 is closed to shut off communication between the switching valve 7 and the mold sand feeding hose 10, and the mold sand discharging air supply hose 17 communicates with the mold sand discharge opening 6 of the switching valve 7.

In that condition, by actuating the pump 15 to introduce suction into the mold sand discharge opening 6 through the mold sand suction hose 11 by supplying ambient air or compressed air into the mold sand discharge opening 6 of the switching valve 7 through the mold sand discharge air supply hose 17. Thus, the suction acts on the mold sand supplying and discharge opening 37 of the hollow core molding portion 2 and the mold sand supplying and discharging opening 35 of the mold sand feeding tank 4 quite effectively so that the non-hardened mold sand Sb within the hollow core molding portion 2 can be directly and externally sucked out and discharged through the mold sand suction hose 11 through the mold sand discharge opening 6 (mold sand supplying and discharging opening 31 and the mold sand flow passage 30).

As set forth above, by connecting the mold sand discharging air supply hose 17 to the switching valve 7 through the mold sand feeding hose 10, the non-hardened mold sand Sb inside of the hardened mold sand Sa can be efficiently discharged to the outside by effective suction acting on the mold sand supplying and discharging opening 37 and the mold sand supplying and discharging opening 35, through the mold sand discharging opening 6 of the switching valve 7 from the mold sand supplying and discharging opening 37 and the mold sand supplying and discharging opening 35. In this connection, the suction of the pump 15 to be introduced into the mold sand suction hose 11 is not required to be excessively high.

Thus, by advantageously providing the air introduction apertures 13 and the closing pins 14 in the divided mold portions 1*a* and 1*b* or by connecting the mold sand discharging air supply hose 17 to the switching valve 7, it becomes unnecessary to introduce excessively high suction of the pump 15 into the mold sand suction hose 11. Therefore, crushing of the hardened mold sand Sa due to forceful suction, as occurred in the prior art, can be successfully prevented to permit fabrication of high quality hollow cores M as shown in FIG. 10(*b*).

Since it becomes unnecessary to apply vibration on the mold, noise pollution in the work environment can be eliminated.

Furthermore, by these embodiments of the present invention, since the suction pump is provided with the inverter 16 for accurately adjusting the suction as shown in FIGS. 4(*a*), 4(*b*) and 5, the suction of the pump 15 can be adjusted by adjusting the inverter 16 to the shape and thickness of the core M to be molded. Thus the possibility of crushing of the hardened mold sand Sa due to the suction and discharging the non-hardened mold sand from the hollow core molding portion 2 can be minimized.

The non-hardened mold sand Sb sucked out and discharged by the mold sand suction hose 11 is recovered within the relay chamber 40. The filter bag 42 within the relay chamber 40 is provided for preventing the recovered mold sand S from entering into the suction pump 15.

The mold sand Sb is recovered in the relay chamber 40 after it passed through the filter 12. By vibration of the filter 12 the mold sand of greater or equal grain size than a predetermined size, is discharged to the exterior. On the other hand, the mold sand Sb with a grain size smaller than the predetermined size, is recycled by feeding it into the hopper 48 which supplies the fresh mold sand, and then is pumped up together with the fresh mold sand by pump 47 to be charged into the mold sand charge hopper 23 through the mold sand supply pipe 49.

The illustrated embodiment of the present invention can achieve a variety of advantageous features. As mold sand S is fed into a hollow core molding portion 2 (FIG. 4) defined by a pair of divided mold portions 1*a* and 1*b* mating with each other, and heated and hardened by contacting the mold sand with a core mold wall 3 (FIG. 4), of the hollow core molding portion 2 by heating of the divided mold portions 1*a* and 1*b*, and non-hardened mold sand Sb within the center portion of the hollow core molding portion 2 is discharged for forming a hollow core M (FIG. 10(*b*)). The apparatus comprises a mold sand feeding tank 4 corresponding to the hollow core molding portion 2 for feeding the mold sand S into the hollow core molding portion 2, and a switching valve 7 disposed within the mold sand feeding tank 4 and having a mold sand feeding opening 5, through which the mold sand S is fed into the mold sand feeding tank 4 from the outside, and a mold sand discharging opening 6, through which non-hardened mold sand Sb within the hollow core molding portion 2 is directly and externally discharged.

With this structure, the mold sand S is fed from the mold sand tank portion 4*a* of the mold sand feeding tank 4 into the hollow core molding portion 2, and while the mold sand S is heated for hardening in the hollow core molding portion 2, the compressed air in the air supply chamber 4*b* is not required to supply sand into the hollow core molding portion 2, thus simplifying the operation.

Upon recovering the non-hardened mold sand in the hollow core molding position 2 after heating and hardening the mold sand in the hollow core molding portion 2, the non-hardened mold sand is sucked out directly by the suction pump 15. Therefore, it becomes possible to quickly recover the mold sand to contribute for improvement of working efficiency. The necessity of discharging the mold sand from the hollow core molding portion 2 by vibration becomes low leading to correspondingly reduced noise pollution.

Upon recovering the non-hardened mold sand through a path other than that used for feeding the mold sand into the hollow core molding portion, and the non-hardened or hardened mold sand are prevented from being fed into the hollow core molding portion. Therefore, the mold sand recovered from the hollow core molding portion 2 can be effectively reused as the core molding sand.

As shown in FIG. 7, in another feature of the described embodiment of the present invention, the mold sand feeding tank 4 comprises a mold sand tank portion 4*a* filled with a mold sand, and an air supply chamber 4*b* located below the tank portion 4*a* and supplying a pressurized air into the tank portion 4*a*. With this structure the mold sand in the mold sand tank portion 4*a* can be fed with certainty into the hollow core molding portion by the compressed air from the air supply chamber 4*b* of the mold sand tank position 4*a*.

As shown in FIG. 7, in a further feature of the illustrated embodiment of the present invention, the switching valve 7 has an outer periphery defining a mold sand feeding surface 8 for feeding the mold sand in the mold sand feeding tank 4 into the hollow core molding portion 2, and an arcuate mold sand blocking surface 9 closing the mold sand feeding tank 4 for preventing leakage of the mold sand in the hollow core molding portion 2 into the mold sand feeding tank 4.

Feeding of the mold sand S can be simply controlled. With this simply structure with the switching valve 7 with the mold sand feeding flat surface 8 for feeding the mold sand S in the mold sand tank 4 into the hollow core molding portion 2 and the arcuate mold sand blocking surface 9 blocking the mold sand feeding tank 4 to avoid leakage of the mold sand in the hollow core molding portion 2 to the mold sand feeding tank 4, formed on the outer peripheral surface. Also, by simply circumferentially pivoting the switching valve 7 feeding of the mold sand and blocking of flow of the mold sand can be selectively done, and the operation becomes quite simple.

In yet further feature of the illustrated embodiment of the present invention, the switching valve 7 is connected to a mold sand feeding hose 10 for feeding the mold sand into the mold sand feeding tank 4 and a mold sand suction hose 11 for discharging the mold sand from the hollow core molding portion 2 to the exterior.

With the illustrated structure, the switching valve 7 is connected to the mold sand feeding hose 10 for feeding mold sand S into the mold sand feeding tank and the mold sand discharging hose 11 for discharging the mold sand S from the hollow core molding portion 2 to the exterior. Therefore, the structure is a simple one for feeding the mold sand S into the mold sand feeding tank 4 and discharging the mold sand S from the hollow core molding portion 2.

In a still further feature of the illustrated embodiment of the present invention, the mold sand Sb sucked out and discharged by the mold sand suction hose 11 from the hollow core molding portion 2 to the exterior, is introduced into a filter 12, where the mold sand filtered through is recirculated into the mold sand feeding tank 4 by the mold sand feeding hose 10. Therefore, even when the semi-hardened or hardened mold sand is discharged from the hollow core molding portion 2, such semi-hardened or hardened mold sand can be separated out by the filter 12. Therefore, only suitable quality and size of mold sand particles can be recycled for reuse.

In a yet further feature of the illustrated embodiment, the divided mold portions 1*a* and 1*b* are formed with an ambient air introduction aperture 13 which is releasably plugged by a closing pin 14 having a tip projecting into the hollow core molding portion 2. In this structure the suction is applied to the hollow core molding portion 2 and the interior space surrounded by the hardened mold sand M contacted with the core mold wall 3 by introducing ambient air through the air introduction apertures 13. Thus, the non-hardened mold sand Sb therein can be quite efficiently sucked out and discharged to the exterior. Therefore, it becomes unnecessary to introduce excessively high suction of the suction pump into the hollow core molding portion 2, to preserve the integrity of the molded hollow core, permitting the fabrication of high quality cores. Furthermore, since the metal wire mesh for applying vibration is unnecessary, noise pollution in the work environment can be eliminated.

In a further feature of the illustrated embodiment of the present invention, the switching valve 7 is connected to the mold sand suction hose 11 including the suction pump 12, in which a suction adjuster inverter 16 is provided. In this structure, the suction to be introduced into the hollow core molding portion 2 can be accurately adjusted adapting to the shape and wall thickness of the core. Therefore, high quality core can be produced.

In a still further feature of the illustrated embodiment, the switching valve 7 is connected to a mold sand feeding hose 10 for feeding the mold sand S into the mold sand feeding tank 4 and a mold sand suction hose 11 discharges the mold sand S from the hollow core molding portion 2 to the exterior, and upon so discharging the mold sand from the hollow core molding portion 2, a mold sand discharging air supply hose 17 is connected to the mold sand discharge opening 6 for supplying the air.

In a yet further feature of the embodiment, the mold sand discharging air supply hose 17 is connected to the mold sand feeding hose 10, and is connected to the switching valve 7 through mold sand feeding hose 10. With this structure by applying suction through the mold sand suction hose 11, the compressed air is supplied to the mold sand discharging opening 6 of the switching valve 7 by the mold sand discharging air supply hose 10. By this, the suction can quite effectively act on the mold sand supplying and discharging opening 37 of the hollow core molding portion 2 and the mold sand supplying and discharging opening 35 of the mold sand feeding tank 4 so that the non-hardened mold sand Sb in the hollow core molding portion 2 can be directly sucked out and discharged to the exterior by the suction effectively acting on the mold sand supplying and discharging opening 37 and 35. Thus, excessive suction of the suction pump can become unnecessary.

I claim:

1. A hollow casting core manufacturing machine, comprising (a) two mateable mold portions, (b) a mold sand feeding tank for feeding mold sand into said mold portions when they are mated to form a mold, (c) means for heating said mold whereby a part of mold sand within said mold heated by said heated mold becomes hardened, (d) a rotatable switching valve disposed within said mold sand feeding tank for selectively passing mold sand into the mold, and for removing nonhardened mold sand from the interior of the mold.

2. The hollow casting core manufacturing machine of claim 1, said mold sand feeding tank comprising a mold sand tank portion for containing mold sand, and an air supply chamber portion located below said mold sand tank portion for supplying compressed air into said mold sand tank portion.

3. The hollow casting core manufacturing machine of claim 1, wherein said rotatable switching valve has an outer peripheral portion defining a sand feeding surface for feeding mold sand from said mold sand feeding tank into the interior of the mated mold portions, and a mold sand flow blocking surface for closing the flow of mold sand from said hollow core into said mold sand feeding tank.

4. The hollow casting core manufacturing machine of claim 3, wherein said sand feeding surface is a flattened surface portion of said switching valve, and said mold sand flow blocking surface is an arcuate surface portion of said switching valve.

5. The hollow casting core manufacturing machine of claim 1, further comprising a mold sand feeding hose for feeding mold sand into said mold sand feeding tank, and a mold sand suction hose for removing by suction mold sand from said mated mold portions, and means for discharging the removed mold sand.

6. The hollow casting core manufacturing machine of claim 5, wherein said means for discharging comprises a filter for separating mold sand into a first fraction that is above a predetermined particle size, and into a second fraction that is at or below said predetermined particle size, and means for discharging said first fraction to the exterior, and said second fraction for recirculation for reuse.

7. The hollow casting core manufacturing machine of claim 1, further comprising an air introduction aperture formed between the mold portions when mated, and a closing pin for selectively projecting into said aperture for plugging the same and for projecting into the hollow core within said mated mold portions.

8. The hollow casting core manufacturing machine of claim 5, further comprising a suction pump, and means for adjusting the suction, said mold sand suction hose being connected from said suction pump and from said rotatable switching valve.

9. The hollow casting core manufacturing machine of claim 5, further comprising a mold sand discharging air supply hose, and said mated mold portions include a mold sand discharge opening, wherein said switching valve is connected through said mold sand feeding hose from said mold sand feeding tank for feeding mold sand into said valve, and said mold sand discharging air supply hose is connected to said mold sand discharge opening.

10. The hollow casting core manufacturing machine of claim 9, wherein said mold sand discharging air supply hose is connected from said mold sand feeding hose, and also from said switching valve through said mold sand feeding hose.

* * * * *